United States Patent [19]

Folkins et al.

[11] Patent Number: 5,063,875

[45] Date of Patent: Nov. 12, 1991

[54] DEVELOPMENT APPARATUS HAVING A TRANSPORT ROLL ROTATING AT LEAST TWICE THE SURFACE VELOCITY OF A DONOR ROLL

[75] Inventors: Jeffrey J. Folkins, Rochester; Joseph G. Schram, Liverpool, both of N.Y.

[73] Assignee: Xerox Corporation, Stamford, Conn.

[21] Appl. No.: 495,178

[22] Filed: Mar. 19, 1990

[51] Int. Cl.[5] ..... G03G 15/06

[52] U.S. Cl. ..... 118/651; 118/647; 118/654; 355/245; 355/247; 355/259; 355/261

[58] Field of Search ..... 355/245, 247, 248, 249, 355/259, 261; 118/647, 651, 653, 654, 660

[56] References Cited

U.S. PATENT DOCUMENTS

| | | | |
|---|---|---|---|
| 3,929,098 | 12/1975 | Liebman | 355/253 X |
| 4,508,052 | 4/1985 | Kohyama | 118/651 |
| 4,518,245 | 5/1985 | Bares | 355/253 |
| 4,743,937 | 5/1988 | Martin | 355/269 |
| 4,868,600 | 9/1989 | Hays et al. | 118/653 X |

FOREIGN PATENT DOCUMENTS

| | | | |
|---|---|---|---|
| 3434434A | 4/1985 | Fed. Rep. of Germany | 355/259 |

*Primary Examiner*—A. T. Grimley
*Assistant Examiner*—J. E. Barlow, Jr.
*Attorney, Agent, or Firm*—H. Fleischer; J. E. Beck; R. Zibelli

[57] ABSTRACT

An apparatus which develops an electrostatic latent image. A transport roll advances developer material from a chamber to a donor roll. The donor roll advances the toner particles to the latent image. The latent image attracts toner particles from the donor roll. In order to improve the speed with which toner particles removed from the donor roll are replaced, an alternating voltage is applied between the two rolls.

The magnetic transport roll is driven to rotate at a surface velocity at least 2, but not more than 5 times that of the rotational surface velocity of the donor roll. Also, the compression pile height (CPH) vs the spacing between the spacing between the donor roll and the transport roller (DRS) is found to be optimal when meeting the ratio CPH:DRS=2:3.

24 Claims, 3 Drawing Sheets

DEVELOPMENT APPARATUS HAVING A TRANSPORT ROLL ROTATING AT LEAST TWICE THE SURFACE VELOCITY OF A DONOR ROLL

This invention relates to an electrophotographic printing machine, and more particularly concerns a development apparatus used therein.

Generally the process of electrophotographic includes charging a photoconductive member to a substantially uniform potential. The charged surface of the photoconductive member is exposed to radiant energy representing the desired indicia on an output document. The radiant energy discharges the charged portion of the photoconductive member selectively to record an electrostatic latent image of the desired indicia thereon. After the electrostatic latent image is recorded on the photoconductive surface, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive surface. The toner powder image is subsequently transferred to a sheet. Finally, the toner powder image is heated to permanently fuse it to the sheet in image configuration.

Single component development systems use a donor roll for transporting charged toner to the development nip defined by the donor roll and photoconductive member. The toner is developed on the latent image recorded on the photoconductive member by a combination of mechanical and/or electrical forces. Scavengeless development and jumping development are two types of single component development. A scavengeless development system uses a donor roll with a plurality of electrode wires closely spaced therefrom in the development zone. An AC voltage is applied to the wires forming a toner cloud in the development zone. The electrostatic fields generated by the latent image attract toner from the toner cloud to develop the latent image. In jumping development, an Ac voltage is applied to the donor roller detaching toner from the donor roll and projecting the toner toward the photoconductive member so that the electrostatic fields generated by the latent image attract the toner to develop the latent image. Single component development systems appear to offer advantages in low cost and design simplicity. However, the achievement of high reliability and easy manufacturability of the system may be present a problem. Two component development systems have been used extensively in many different types of printing machines. A two component development system usually employs a magnetic brush developer roller for transporting carrier having toner adhering triboelectrically thereto. The electrostatic fields generated by the latent image attract the toner from the carrier so as to develop the latent image. In high speed commercial printing machines, a two component development system may have lower operating costs than a single component development system. Clearly, two component development systems and single component development systems each have their own advantages. Accordingly, it is desirable to combine these systems to form a hybrid development system having the desirable features of each system. For example, at the 2nd International Congress on Advances in Non-impact Printing held in Washington, D.C. on Nov. 4–8, 1984, sponsored by the Society for Photographic Scientists and Engineers, Toshiba described a development system using a donor roll and a magnetic roller. The donor roll and magnetic roller were electrically biased. The magnetic roller transported a two component developer material to the nip defined by the donor roll and magnetic roller. Toner is attracted to the donor roll from the magnetic roll. The donor roll is rotated synchronously with the photoconductive drum with the gap therebetween being about 0.20 millimeters. The large difference in potential between the donor roll and latent image recorded on the photoconductive drum causes the toner to jump across the gap from the donor roll to the latent image so as to develop the latent image. Various other types of development systems have been devised. The following disclosures appear o be relevant:

| |
|---|
| U.S. Pat. No. 4,383,497 |
| Patentee: Tajima |
| Issued: March 17, 1983 |
| U.S. Pat. No. 4,508,052 |
| Patentee: Kohyama |
| Issued: April 2, 1985 |
| U.S. Pat. No. 4,686,934 |
| Patentee: Kohyama |
| Issued: August 18, 1987 |
| Co-pending U.S. patent application No. 07/171,062 now U.S. Pat. No. 4,868,600 |
| Patentee: Hayes et al. |
| Filed: March 21, 1988 |
| Co-pending U.S. patent application No. 07/396,153 |
| Applicant: Folkins |
| Filed: August 21, 1989 |

The relevant portions of the foregoing disclosures may be briefly summarized as follows:

U.S. Pat. No. 4,383,497 discloses a development systems in which a lower magnetic roll attracts carrier granules having toner particles adhering thereto. The carrier granules and toner particles are carried by rotation of the outer sleeve of the magnetic roll into a zone between the magnetic roll and a rotary developer roll. Toner particles are attracted from the carrier granules to become deposited in a uniform layer on the developer roll. The developer roll advances the toner particles to a photoreceptor having an electrostatic latent image recorded thereon. The toner particles are selectively induced to leave the developer rola and become deposited on the latent image in order to render it visible. A.D.C. biased alternating current is applied to the developer roll. The magnetic roll is electrically grounded. This forms a voltage across the developing roll and the magnetic roll to accelerate movement of the toner particles from the magnetic roll to the developer roll.

U.S. Pat. No. 4,508,052 and U.S. Pat. No. 4,686,934 describe an A.C. voltage source connected to a developer roll and a D.C. voltage source connected between the developer roll and a magnetic roll. The magnetic roll is rotated at a peripheral speed of two or three times the speed of the developer roll in the same or opposite direction.

Co-pending U.S. patent application Ser. No. 07/171,062 now U.S. Pat. No. 4,868,600 discloses a 'scavengeless' development system development system in which a donor roll has toner deposited thereon. A pair of electrodes, closely spaced from the donor roll, is positioned in the gap between the donor roll and the photoconductive member. An A.C. voltage is applied to the electrodes to detach toner from the donor roll and form a toner powder cloud in the gap. Toner from the cloud is attracted to the latent image recorded on the photoconductive member to develop it. A conventional magnetic brush used with two-component developer could be used for depositiong the toner layer on to the donor roll.

Co-pending U.S. patent application Ser. No. 07/396,153 describes an apparatus wherein a magnetic roll transports two component developer t a transfer region wherein toner from the magnetic roll is transferred to a donor roll. The donor roll transports toner to a region opposed from a surface on which a latent image is recorded. A pair of electrode wires are positioned in the space between the surface and the donor roll and are electrically biased to detach toner from the donor roll to form a toner cloud. Detached toner from the cloud develops the latent image.

In accordance with one apect of the present invention, there is provided an apparatus for developing a latent image. The apparatus includes a housing defining a chamber for storing a supply of developer material therein. A donor roll, mounted at least partially in the chamber of the housing, is adapted to advance developer material to the latent image. A transport roll, mounted in the chamber of the housing and positioned adjacent the donor roll is adapted to advance developer material to the donor roll. Means are provided for rotating the transport roll and the donor roll so that the surface velocity of the transport roll is at least twice the surface velocity of the donor roll. Means apply an alternating electrical field between the donor roll and the transport roll to assist in transferring a portion of the developer material from the transport roll to the donor roll.

Pursuant to another aspect of the present invention, there is provided an apparatus for developing an electrostatic latent image recorded on a moving photoconductive member. The apparatus includes a housing defining a chamber for storing a supply of developer material therein. A donor roll, mounted at least partially in the chamber of the housing, advances developer material to the photoconductive member to develop the electrostatic latent image recorded thereon. A transport roll, mounted in the chamber of housing and positioned adjacent the donor roll, advances developer mateial to the donor roll. Means are provided for rotating the transport roll and the donor roll so that the surface velocity of the transport roll is at least twice the surface velocity of the donor roll. Means apply an alternating electric field between the donor roll and the transport roll to assist in transferring a portion of the developer material from the transport roll to the donor roll.

Other features of the present invention will become apparent as the following description proceeds and upon reference to the drawings, in which.

Figure 3:
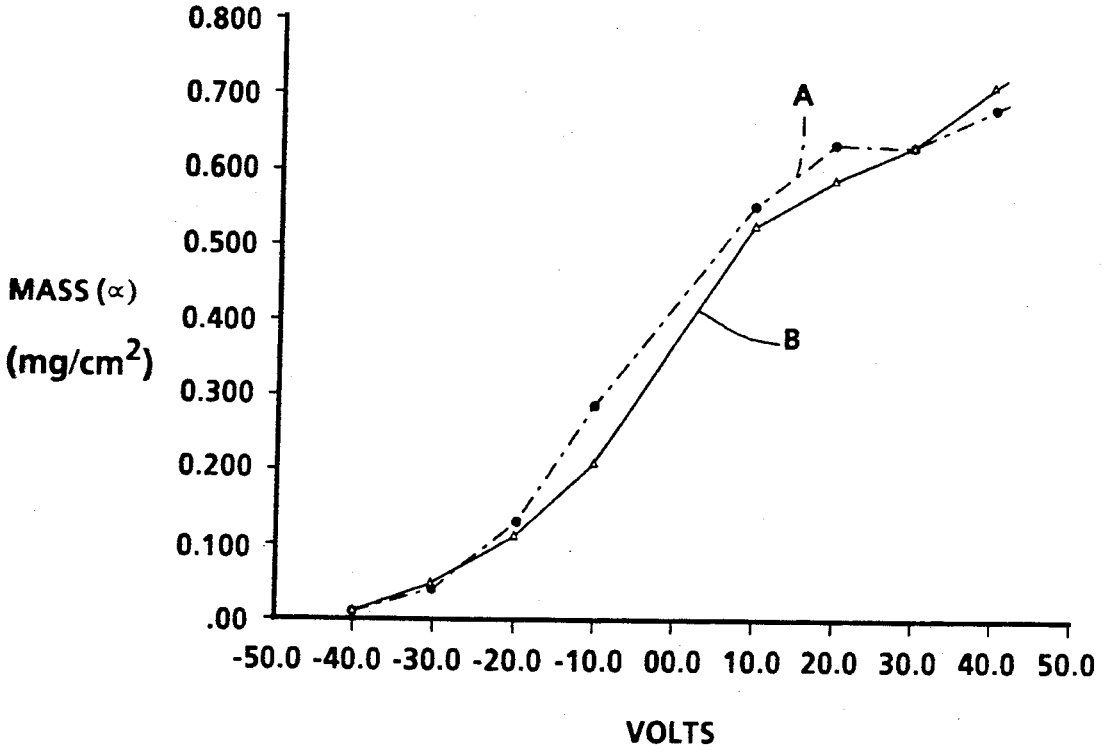
Figure 4:
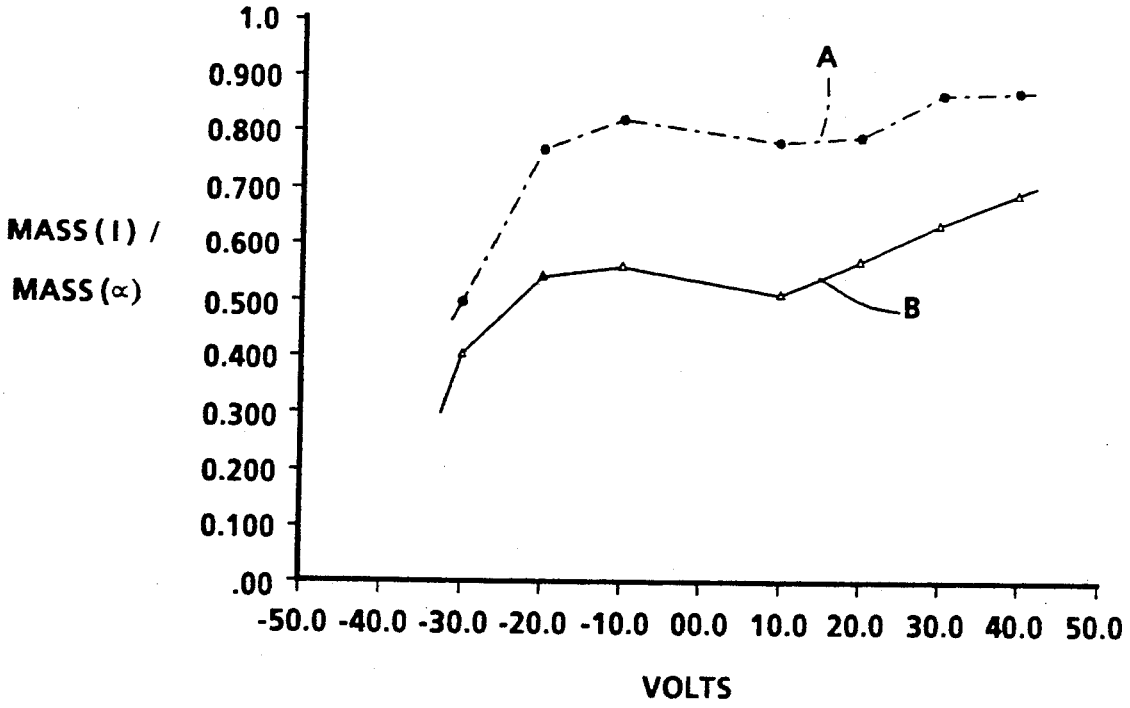

FIG. 3 shows two curves relating the mass of toner transferred from the magnetic roll to the donor roll after several passes to the voltage applied between the transport roll and the donor roll, and FIG. 4 shows two curves relating the mass of toner transferred to the donor roll after one pass divided by the mass of toner transferred to the donor roll after several passes to the voltage between the transport roll and the donor roll.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
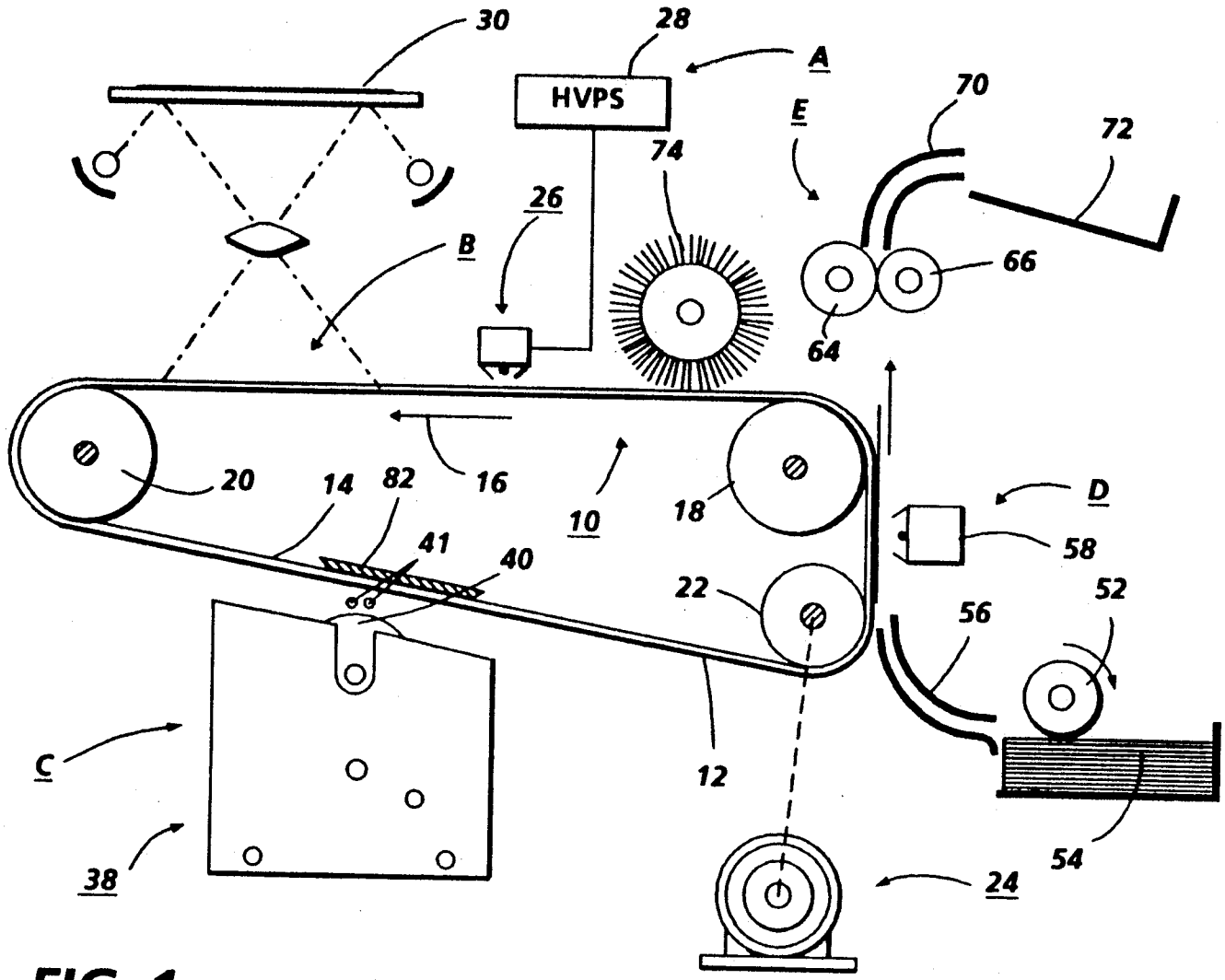
FIG. 1 is a schematic elevational view of an illustrative electrophotographic printing machine incorporating a development apparatus having the features of the present invention therein.

Referring initially to FIG. 1, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26. After charging, the charged area of surface 12 is passed to exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconducitve surface 12, belt 10 advances the latent image to development station C. At development station C, a development system, develops the latent image recorded on the photoconductive surface. Preferably, development system includes a donor roller 40 and electrode wires positioned in the gap between the donor roll and photoconductive belt. Electrode wires 41 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 38. The chamber in developer housing 44 stores a supply of developer material. The developer material is a two component developer material of at least magnetic carrier granules having toner particles adhering triboelectrically thereto. One skilled in the art will appreicate that a single component developer material of magnetic toner particles may also be used. A magnetic roller disposed interiorly of the chamber of housing 38 conveys the developer material to the donor roller. The magnetic roller is electrically biased relative to the donor roller so that the toner particles are attracted from the magnetic roller to the donor roller. The development apparatus will be discussed hereinafter, in greater detail, with reference to FIG. 2.

With continued reference to FIG. 1, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 the sheet. As the belt turns a round roller 18, the sheet is stripped therefrom with the toner image thereon.

After transfer, the sheet is advanced by a conveyor (not shown) to fusing station E. Fusing staion E includes a heater fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparaus of the present invention therein.

Figure 2:
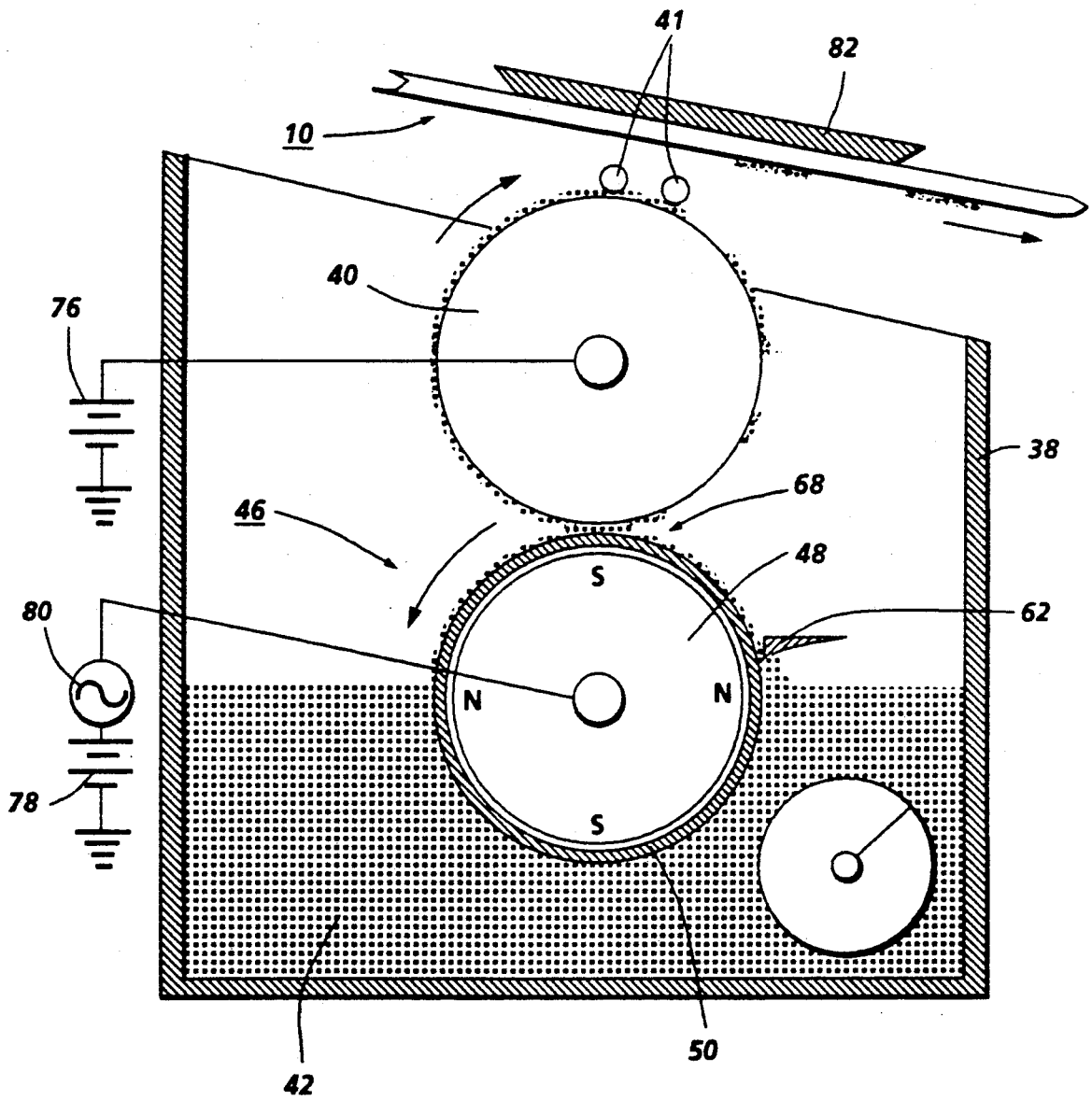
FIG. 2 is a schematic elevational view showing the development apparatus used in the FIG. 1 printing machine.

Referring now to FIG. 2, there is shown development system 38 in greater detail. Housing 38 defines a chamber for storing a supply of developer material therein. Positioned in the bottom of housing 38 is a horizontal auger which distributes developer material uniformly along the length of transport roll 46, so that the lowermost part of roll 46 is always immersed in a body of developer material.

Transport roll 46 comprises a stationary multi-polar magnet 48 having a closely spaced sleeve 50 of non-magnetic material, preferably aluminum, designed to be rotated about the magnetic core 48 in a direction indicated by arrow 60. Because the developer material includes magnetic carrier granules, the effect of the sleeve rotating through stationary magnetic fields is to cause developer material to be attracted to the exterior of the sleeve. A doctor blade 62 is used to limit the radial depth of developer remaining adherent to sleeeve 50 as it rotates to the nip 68 between transport roll 46 and donor roll 40. The donor roll is kept at a specific voltage, by a DC power supply 76, to attract a thin layer of toner particles from transport roll 46 in nip 68 to the surface of donor roll 40. Either the whole of the donor roll 40, or at least a peripheral layer thereof, is preferably of material which has low electrical conductivity. The material must be conductive enough to prevent any build-up of electric charge with time, and yet its conductivity must be low enough to form a blocking layer to prevent shorting or arcing of the magnetic brush to the donor roll. In one preferred form of apparatus of the present invention, the donor roll has a surface coating of anodized aluminum some 50 $\mu$m in radial thickness, and which has an electrical conductivity of about $10-^{11}$(ohm-cm)$-^{1}$.

Transport roll 46 is biased by both a DC voltage source 78 and an AC voltage source 80. The effect of the DC electrical field is to enhance the attraction of developer material to sleeve 50. It is believed that the effect of the AC electrical field applied along the transport roll in nip 68 is to loosen the toner particles from their adhesive and triboelectric bonds to the carrier particles.

It has been found that a value of up to 200 $V_{rms}$ is sufficient for the output of source 80 for the desired level of reload efficiency of toner particles to be achieved. The actual value can be adjusted empirically: in theory it could be any value up to a voltage of about 400 $V_{rms}$. The source should be at a frequency of about 4 KHz. If the frequency is too low, e.g. less than 200 Hz, banding will appear on the copies. If it is too high, e.g. more than 15 KHz, it would probably work but the electronics would become too expensive because of capacitive loading losses.

Electrode wires 41 are disposed in the space between the belt 10 and donor roller 40. A pair of electrode wires are shown extending in a direction substantially parallel to the longitudinal axis of the donor roller. The electrode wires are made from of one or more thin (i.e. 50 to 100 $\mu$ diameter) tungsten wires which are closely spaced from donor roller 40. The distance between the wires and the donor roller is approximately 25 $\mu$ or the thickness of the toner layer on the donor roll. The wires are self-spaced from the donor roller by the thickness of the toner on the donor roller. To this end the extremities of the wires supported by the tops of end bearing blocks also support the donor roller for rotation. The wire extremities are attached so that they are slightly below a tangent to the surface, including toner layer, of the donor structure. Mounting the wires in such a manner makes them insensitive to roll runout due to their self-spacing An alternating electrical bias is applied to the electrode wires by an AC voltage source. The applied AC establishes an alternating electrostatic field between the wires and the donor roller which is effective in detaching toner from the surface of the donor roller and forming a toner cloud about the wires, the height of the cloud being such as not to be substantially in contact with the belt 10.

At the region where the photoconductive belt 10 passes closest to donor roll 40, a stationary shoe 82 bears on the inner surface of the belt. The position of the shoe relative to the donor roll establishes the spacing between the donor roll and the belt. The position of the show is adjustable and it is positioned so that the spacing between the donor roll and photoconductive belt is preferably about 0.25 mm.

Another factor which has been found to be of importance is the speed with which the sleeve 50 is rotated relative to the speed of rotation of donor roll 40. In practice both would be driven by the same motor, but a gear train would be included in the drive system so that sleeve 50 is driven at a significantly faster surface velocity than is donor roll 40. A transport roll:donor roll speed ratio of 3:1 has been found to be particularly advantageous, and even higher relative speeds might be used in some embodiments of the invention. In other embodiments the speed ratio may be as low as 2:1.

It has also been found that the nature of the magnetic fields produced by core 48 can affect the reload efficiency. In particular, it has been found that the efficiency is increased when the magnetic fields in the nip 68 have relatively low tangential components.

It can be seen from FIG. 3 that the presence of the A.C. bias provided by voltage source 80 has relatively little effect on the mass of developer transferred to the donor roll as a function of the voltage difference between the rolls. Curve B is produced when no A.C. bias is applied. Curve A is obtained when a bias of 100 $V_{rms}$ is applied. It will be seen that the small area between these two curves shows that the A.C. bias has little effect over a long period.

However, FIG. 4 demonstrates that the reload efficiency is significantly improved by the application of this bias. In FIG. 4, curve B is obtained when no A.C. bias is applied. Curve A represents the results obtained when a bias of 100 $V_{rms}$ is applied. The significant difference between these two curves demonstrates that, almost entirely independent of the D.C. bias between the two rolls, the presence of the A.C. bias causes the amount of toner transferred to the donor roll in its first pass to be a significantly high proportion of the total mass of toner transferred to the donor roll after several passes. In other words, the present invention is successful in insuring that a significant proportion of the toner removed from the donor roll by the photoreceptor is replaced on the donor roll by a single pass through nip 68. It will be appreciated that these graphs were arrived at by altering the relative values, and even the polarities, of the direct voltages applied by power sources 76 and 78 to the donor roll and transport roll. The curves show that, at a voltage difference between the two rolls of 30–40 V, the reload efficiency is so high, and the mass of developer transferred to the donor roll after several passes is also so high, that there is little to be gained by increasing this potential difference. This applies to a particular toner and degree of abrasiveness of the nip 68. With other toners etc. the voltage between the rolls may vary between 50 and 200 V. Depending on the nature of the donor roll material, the A.C. bias 80 may range up to about 300 $V_{rms}$, although it is preferably about 200 $V_{rms}$.

It has been found that there is a relationship between the amount of toner on the donor roll and the spacing between the donor roll and the transport roller (DRS). The amount of toner is often expressed as the 'compressed pile height' (CPH), which is a quantity representing the height of toner on the donor roll if it were virtually free of voids, i.e. after the toner had been compressed radially. Preferably, the CPH is in the order of about 1.5 mm, while the DRS is about 2.25 mm. It thus seems that a CPH:DRS ratio of 2:3 is optimal. Certainly greater amounts of toner cause it to roll back, and lesser amounts lead to a reduction in the amount of toner transferred to the photocoductive belt in the first pass after depletion.

One skilled in the art will appreciate that while an electrophotographic printing machine has been described, the features of the present invention may be used in an ionographic printing machine. In an ionographic printing machine, the electrostatic latent image is recorded on an electroreceptor by the selective incidence of ions.

It is, therefore, apparent that there has been provided in accordance with the present invention, a development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for developing a latent image, including;

a housing defining a chamber for storing a supply of developer material therein;

a donor roll mounted at least partially in the chamber of said housing, said donor roll being adapted to advance developer material to the latent image;

a magnetic transport roll mounted in the chamber of said housing and being positioned adjacent said donor roll, said transport roll being adapted to advance developer material to said donor roll;

means for rotating said transport roll and said donor roll so that the surface velocity of said transport roll is at least twice the surface velocity of said donor roll; and means for applying an alternating electric field between said donor roll and said transport roll to assist in transferring at least a portion of the developer material from said transport roll to said donor roll.

2. An apparatus according to claim 1, wherein the developer material includes toner particles.

3. An apparatus according to claim 1, wherein the developer material includes carrier granules having toner particles adhering triboelectrically thereto with the portion of the developer material being transferred from said transport roll to said donor roll being toner particles.

4. An apparatus according to claim 2 or 3, further including an electrode member positioned in the space between the latent image and said donor member, said electrode member being closely spaced from said donor member and being electrically biased to detach toner particles from said donor member so as to form a toner powder cloud in the space between said electrode member and the latent image with detached toner particles from the toner cloud developing the latent image.

5. An apparatus according to claim 4, where said electrode member includes a plurality of small diameter wires.

6. An apparatus according to claim 3, wherein said applying means applies an electrical field that alternates at a selected frequency ranging between about 200 Hz and about 20 kHz with a voltage less than 400 $V_{rms}$.

7. An apparatus according to claim 1, wherein:

said donor roll includes a surface made from an electrically conductive material to allow surface charges to dissipate; and said transport roll includes a surface made from an electrically conductive material to allow surface charges to dissipate.

8. An apparatus according to claim 6, wherein:

said surface of said donor roll has an electrical conductivity of at least $10^{-13}$ (ohm.cm)$^{-1}$; and said surface of said transport roll has an electrical conductivity of at least $10^{-13}$ (ohm.cm)$^{-1}$.

9. An apparatus according to claim 8, wherein the electrical conductivities of the surfaces of said donor roll and said transport is preferably about $10^{-11}$ $(ohm.cm)^{-1}$.

10. An apparatus according to claim 1, in which the ratio of the height of the layer of developer material on said donor roll to the minimum spacing between said donor roll and said transport roll is about 2:3.

11. An apparatus according to claim 1, said rotating means rotates said transport roll and said donor roll so that the ratio of the surface velocity of said transport roll to the surface velocity of said donor roll is less than 5:1.

12. An apparatus according to claim 11, wherein said rotating means rotates said transport roll and said donor roll so that the ratio of the surface velocity of said transport roll to the surface velocity of said donor roll is preferably about 3:1.

13. An apparatus for developing an electrostatic latent image recorded on a moving photoconductive member, including:

a housing defining a chamber for storing a supply of developer material therein;

a donor roll mounted at least partially in the chamber of said housing to advance developer material to the photoconductive member to develop the electrostatic latent image recorded thereon;

a magnetic transport roll mounted in the chamber of said housing and being positioned adjacent said donor roll to advance developer material to said donor roll;

means for rotating said transport roll and said donor roll so that the surface velocity of said transport roll is at least twice the surface velocity of said donor roll; and means for applying an alternating electric field between said donor roll and said transport roll to assist in transferring a portion of the developer material from said transport roll to said donor roll.

14. An apparatus according to claim 13, wherein the developer material includes toner particles.

15. An apparatus according to claim 13, wherein the developer material includes carrier granules having toner particles adhering triboelectrically thereto with the portion of the developer material being transferred from said transport roll to said donor roll being toner particles.

16. An apparatus according to claims 14 or 15, further including an electrode member positioned in the space between the photoconductive member and said donor member, said electrode member being closely spaced from said donor member and being electrically biased to detach toner particles from said donor member so as to form a toner powder cloud in the space between said electrode member and the photoconductive member with detached toner particles from the toner cloud developing the latent image.

17. An apparatus according to claim 16, where said electrode member includes a plurality of small diameter wires.

18. An apparatus according to claim 15, wherein said applying means applies an electrical field that alternates at a selected frequency ranging between about 200 Hz and about 20 kHz with a voltage less than 400 $V_{rms}$.

19. An apparatus according to claim 13, wherein:

said donor roll includes a surface made from an electrically conductive material to allow surface charges to dissipate; and said transport roll includes a surface made from an electrically conductive material to allow surface charges to dissipate.

20. An apparatus according to claim 19, wherein:

said surface of said donor roll has an electrical conductivity of at least $10^{-13}$ $(ohm.cm)^{-1}$; and said surface of said transport roll has an electrical conductivity of at least $10^{-13}$ $(ohm.cm)^{-1}$.

21. An apparatus according to claim 20, wherein the electrical conductivities of the surfaces of said donor roll and said transport is preferably about $10^{-11}$ $(ohm.cm)^{-1}$.

22. An apparatus according to claim 13, in which the ratio of the height of the layer of developer material on said donor roll to the minimum spacing between said donor roll and said transport roll is about 2:3.

23. An apparatus according to claim 13, said rotating means rotates said transport roll and said donor roll so that the ratio of the surface velocity of said transport roll to the surface velocity of said donor roll is less than 5:1.

24. An apparatus according to claim 23, wherein said rotating means rotates said transport roll and said donor roll so that the ratio of the surface velocity of said transport roll to the surface velocity of said donor roll is preferably about 3:1.

* * * * *